US007351103B1

(12) United States Patent
Peng et al.

(10) Patent No.: US 7,351,103 B1
(45) Date of Patent: Apr. 1, 2008

(54) MICRO-SERIAL PORT ELECTRIC CONNECTOR

(75) Inventors: Jian-Min Peng, Jong-Jiang Hsien (CN); Shou-Chao Chen, Ma-Cherng (CN)

(73) Assignee: Su-Lan Yang Lee, Taipei Hsien (TW)

( * ) Notice: Subject to any disclaimer, the term of this patent is extended or adjusted under 35 U.S.C. 154(b) by 0 days.

(21) Appl. No.: 11/723,212

(22) Filed: Mar. 19, 2007

(30) Foreign Application Priority Data

Feb. 14, 2007 (TW) ..... 96202788 U

(51) Int. Cl.
*H01R 13/40* (2006.01)

(52) U.S. Cl. ..... 439/595

(58) Field of Classification Search ..... 439/607–610, 439/660, 595, 353, 296, 345, 350
See application file for complete search history.

(56) References Cited

U.S. PATENT DOCUMENTS 7,033,218 B2 * 4/2006 Huang et al. ..... 439/607
7,198,522 B1 * 4/2007 Ho et al. ..... 439/660
2006/0228946 A1 * 10/2006 Chung ..... 439/607

* cited by examiner

*Primary Examiner*—Edwin A. Leon
(74) *Attorney, Agent, or Firm*—Rosenberg, Klein & Lee

(57) ABSTRACT

A micro-serial port electric connector including an insulating main body and a latch member. Multiple contact terminals are inlaid in the insulating main body. The insulating main body is formed with an insertion slot having a U-shaped insertion passage. The latch member has an insertion section and two latch arms. The insertion section includes a U-shaped insertion section inlaid in the U-shaped insertion passage of the insertion slot of the insulating main body. The two latch arms respectively integrally extend from two ends of the U-shaped insertion section into the U-shaped insertion passage of the insulating main body for resiliently engaging with another electric connector.

8 Claims, 7 Drawing Sheets

MICRO-SERIAL PORT ELECTRIC CONNECTOR

BACKGROUND OF THE INVENTION

1. Field of the Invention

The present invention is related to an improved micro-serial port electric connector including an insulating main body and a latch member with improved structures.

2. Description of the Prior Art

FIG. 8 shows a conventional micro-serial port electric connector having an insulating main body 50 and two separate L-shaped latch members 60. Two sides of the insulating main body 50 are respectively formed with two insertion slots 51. Each latch member 60 has an insertion section 61 fixedly inlaid in the insertion slot 51 of the insulating main body 50. Each latch member 60 has a free resilient latch arm 62 extending into a receiving channel 52 communicating with the insertion slot 51. The above structure has some shortcomings as follows:

1. The sectional face of the latch member 60 serves as the locating face. Due to the limitation of the thickness of the material, the locating face has a small forced area. However, the latch members 60 are the major forced subjects so that the corresponding locating faces of the insulating main body 50 tend to deform. As a result, the latch members 60 are apt to loosen. This will lead to unstable connection between the male and female electric connectors.
2. The sectional faces of the latch members 60 are inserted in the insulating main body 50 to fix the latch members 60 therein. This prevents the latch members 60 from being retreated when used under external force. However, the insertion sections 61 of the latch members 60 are not well designed so that the latch members 60 are apt to loosen and become unfixed.
3. Each electric connector necessitates two latch members 60 respectively fixed on two sides of the insulating main body 50. Therefore, when assembled, it is necessary to respectively mount the latch members 60 on two sides of the insulting main body 50 twice. This lowers the assembling efficiency.

SUMMARY OF THE INVENTION

It is therefore a primary object of the present invention to provide a micro-serial port electric connector including an insulating main body and a latch member. Multiple contact terminals are inlaid in the insulating main body. The insulating main body is formed with an insertion slot composed of: a U-shaped insertion passage extending in a direction in which the contact terminals are inserted into the insulating main body; a first locating channel extending from a middle section of the U-shaped insertion passage in the direction in which the contact terminals are inserted into the insulating main body; a locating pit formed under the first locating channel to communicate therewith; and a second locating channel extending from two ends of the U-shaped insertion passage in the direction in which the contact terminals are inserted into the insulating main body. The latch member has an insertion section inserted in the insertion slot of the insulating main body. The insertion section includes: a U-shaped insertion section inlaid in the U-shaped insertion passage of the insertion slot of the insulating main body; a first locating section extending from the U-shaped insertion section in the direction in which the contact terminals are inserted into the insulating main body, the first locating section being inserted in the first locating channel of the insertion slot of the insulating main body, the first locating section having a latch section extending in a direction reverse to the direction in which the contact terminals are inserted into the insulating main body, the latch section being fixedly latched in the locating pit under the first locating channel so as to fix the latch member in the insertion slot of the insulating main body; and a second locating section extending from two ends of the U-shaped insertion section in the direction in which the contact terminals are inserted into the insulating main body, the second locating section being inserted in the second locating channel of the insertion slot of the insulating main body. The latch member further has two latch arms respectively extending from two ends of the U-shaped insertion section in the direction in which the contact terminals are inserted into the insulating main body. The latch arms respectively resiliently extend into the U-shaped insertion passage of the insulating main body. Each latch arm has a latch hook at the free end. The latch hooks are exposed to outer side of the insulating main body for resiliently engaging with another electric connector.

In the above micro-serial port electric connector, each latch hook has a guide slope formed on a rearmost free end of the latch arm for the latch hook to easily slip into another electric connector. The latch hook further has a latch slope opposite to the guide slope for latching with another electric connector and guiding the other electric connector to slip away from the electric connector.

In the above micro-serial port electric connector, the latch member is integrally made from a piece of metal material to have the insertion section and the two latch arms.

It is a further object of the present invention to provide a micro-serial port electric connector including an insulating main body and a latch member. Multiple contact terminals are inlaid in the main body. The insulating main body is formed with an insertion slot having a U-shaped insertion passage. The latch member has an insertion section inserted in the insertion slot of the insulating main body. The insertion section includes: a U-shaped insertion section inlaid in the U-shaped insertion passage of the insertion slot of the insulating main body; and two latch arms respectively extending from two ends of the U-shaped insertion section in the direction in which the contact terminals are inserted into the insulating main body. The latch arms respectively resiliently extend into the U-shaped insertion passage of the insulating main body. Each latch arm has a latch hook at the free end. The latch hooks are exposed to outer side of the insulating main body for resiliently engaging with another electric connector.

In the above micro-serial port electric connector, each latch hook has a guide slope formed on a rearmost free end of the latch arm for the latch hook to easily slip into another electric connector. The latch hook further has a latch slope opposite to the guide slope for latching with another electric connector and guiding the other electric connector to slip away from the electric connector.

In the above micro-serial port electric connector, the latch member is integrally made from a piece of metal material to have the insertion section and the two latch arms.

In the above micro-serial port electric connector, the insulating main body further has a first locating channel extending from a middle section of the U-shaped insertion passage in the direction in which the contact terminals are inserted into the insulating main body.

In the above micro-serial port electric connector, the latch member further has a first locating section extending from the U-shaped insertion section in the direction in which the contact terminals are inserted into the insulating main body. The first locating section is inserted in the first locating channel of the insertion slot of the insulating main body. The first locating section has a latch section extending in a direction reverse to the direction in which the contact terminals are inserted into the insulating main body, whereby the entire latch member can be fixedly latched in the insulating main body.

In the above micro-serial port electric connector, the insulating main body further has a locating pit formed under the first locating channel to communicate therewith. The first locating section has a latch section fixedly latched in the locating pit under the first locating channel so as to fix the latch member in the insertion slot of the insulating main body.

In the above micro-serial port electric connector, the insulating main body further has a second locating channel extending from two ends of the U-shaped insertion passage in the direction in which the contact terminals are inserted into the insulating main body. The latch member further has a second locating section extending from two ends of the U-shaped insertion section in the direction in which the contact terminals are inserted into the insulating main body. The second locating section is inserted in the second locating channel of the insertion slot of the insulating main body.

The present invention can be best understood through the following description and accompanying drawings wherein:

DETAILED DESCRIPTION OF THE PREFERRED EMBODIMENTS

Figure 3:
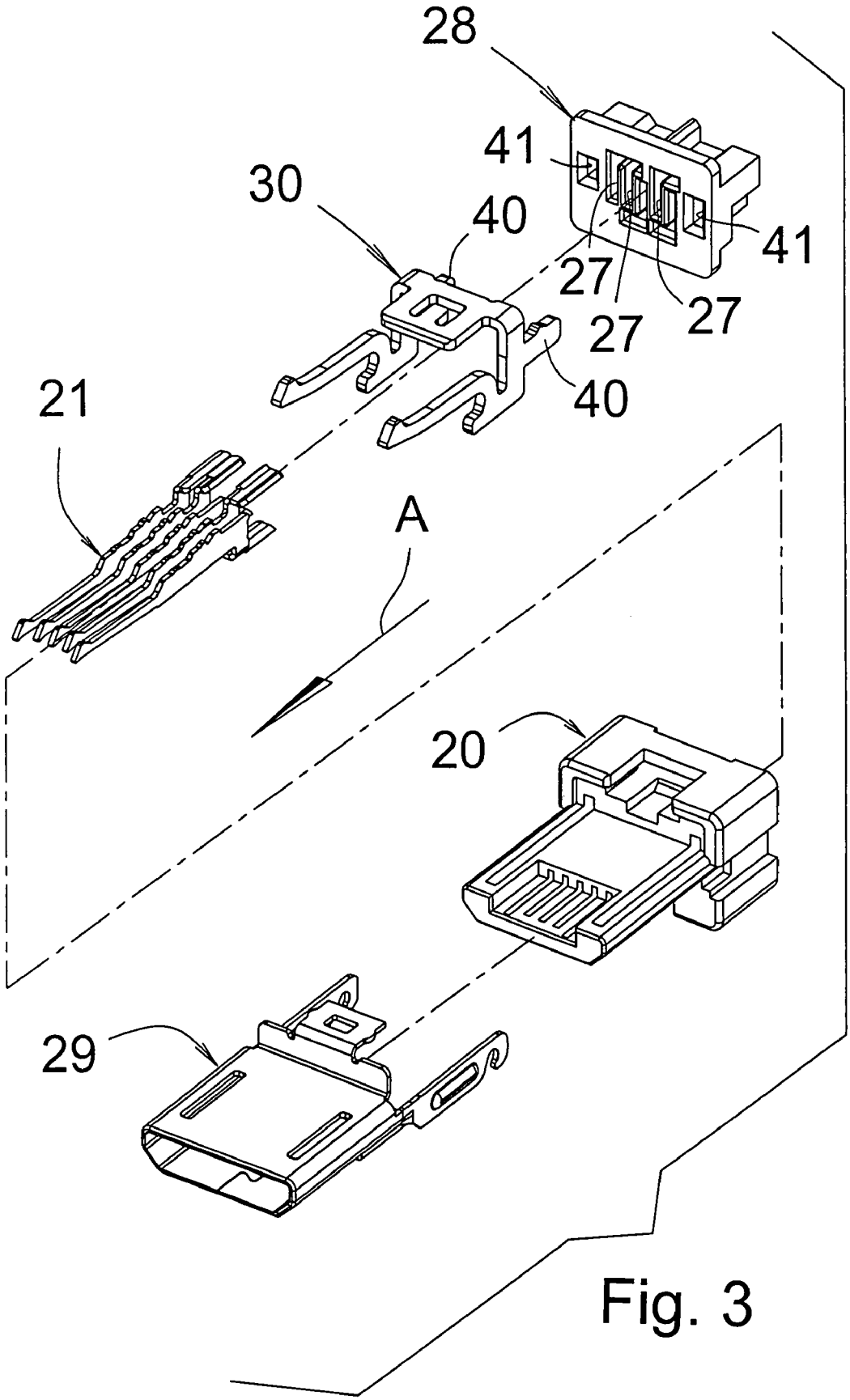
FIG. 3 is a perspective exploded view of the entire electric connector of the present invention, seen from front end.
Figure 4:
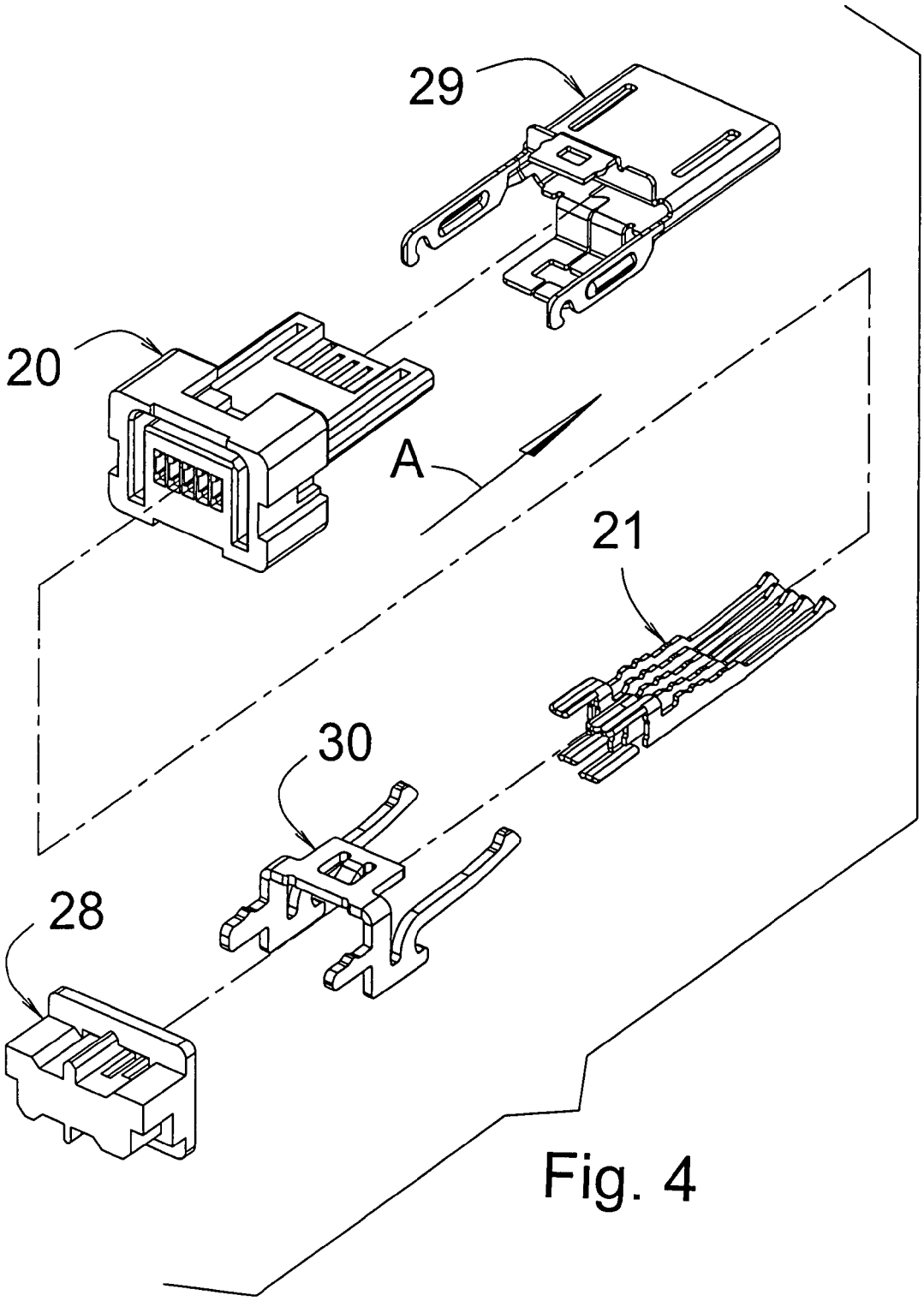
FIG. 4 is a perspective exploded view of the entire electric connector of the present invention, seen from rear end.
Figure 5:
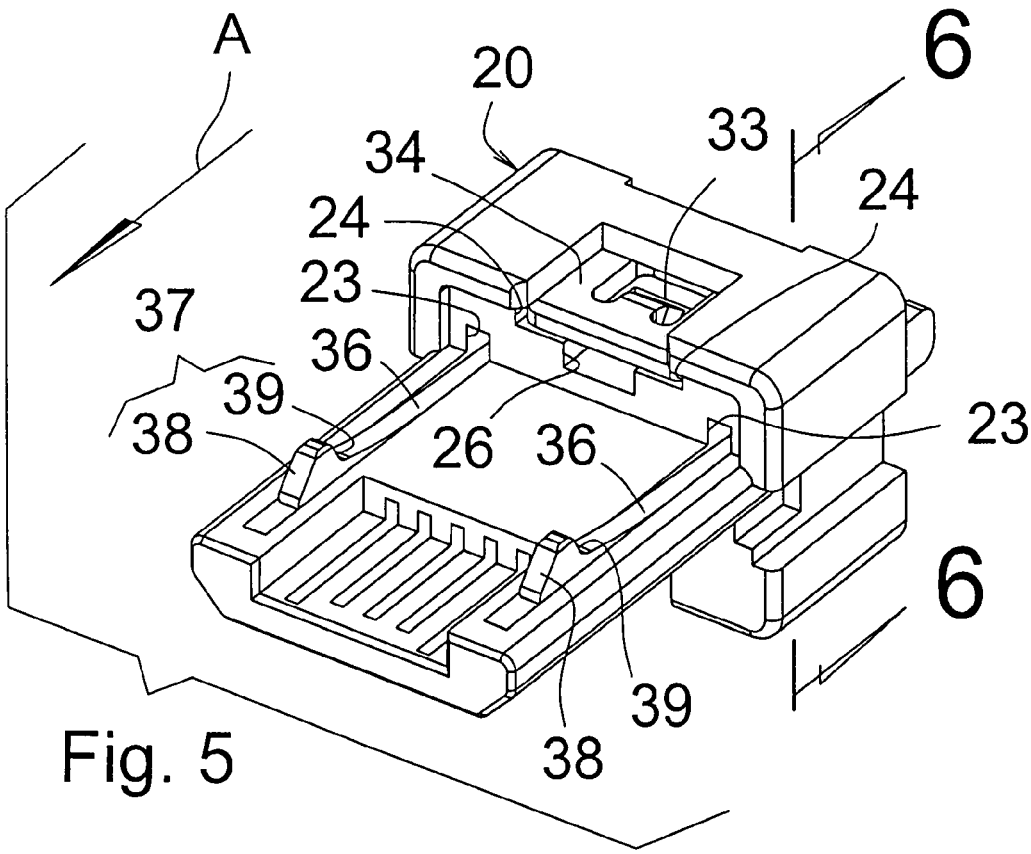
FIG. 5 is a partially assembled view of the electric connector of the present invention.

Please refer to FIGS. 3 and 4. The micro-serial port electric connector of the present invention includes an insulating main body 20 having multiple terminal cavities 27; multiple contact terminals 21 inlaid in the terminal cavities 27 of the insulating main body 20; a latch member 30 inserted in the insulating main body 20; a rear cap 28 fitted on a rear end of the insulating main body 20 for enclosing the contact terminals 21 and the latch member 30; and a shield casing 29 enclosing a front end of the insulating main body 20.

Figure 6:
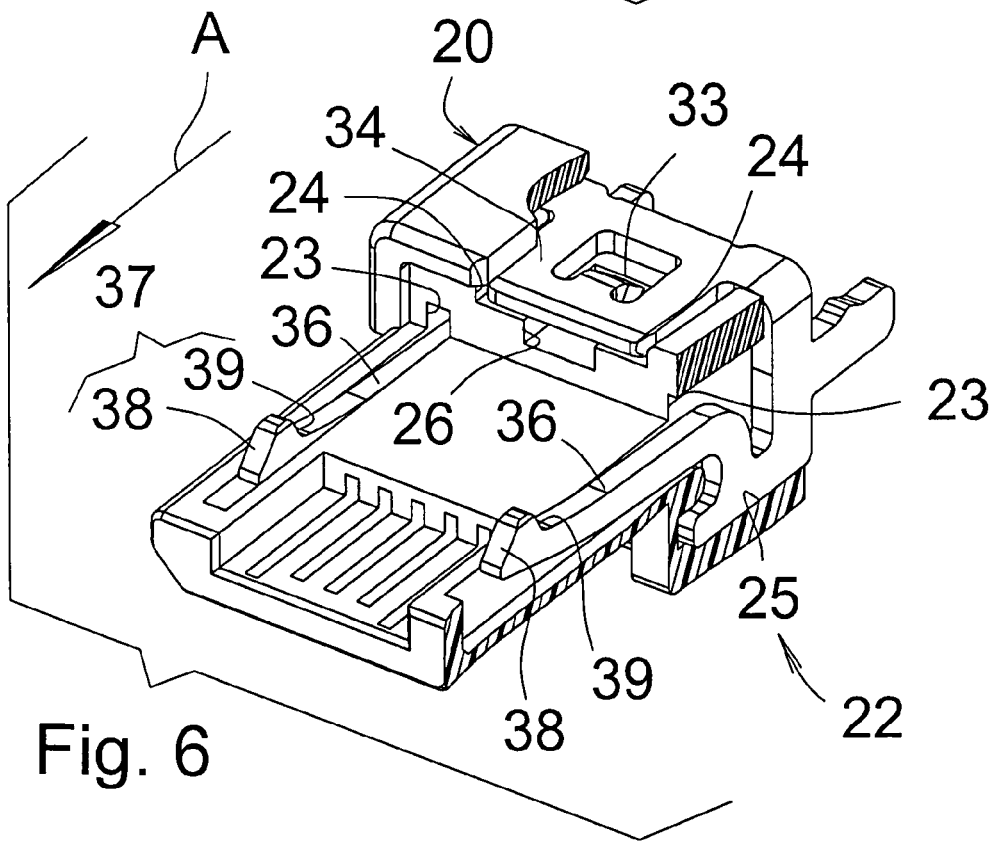
FIG. 6 is a sectional view taken along line 6-6 of FIG. 5.
Figure 7:
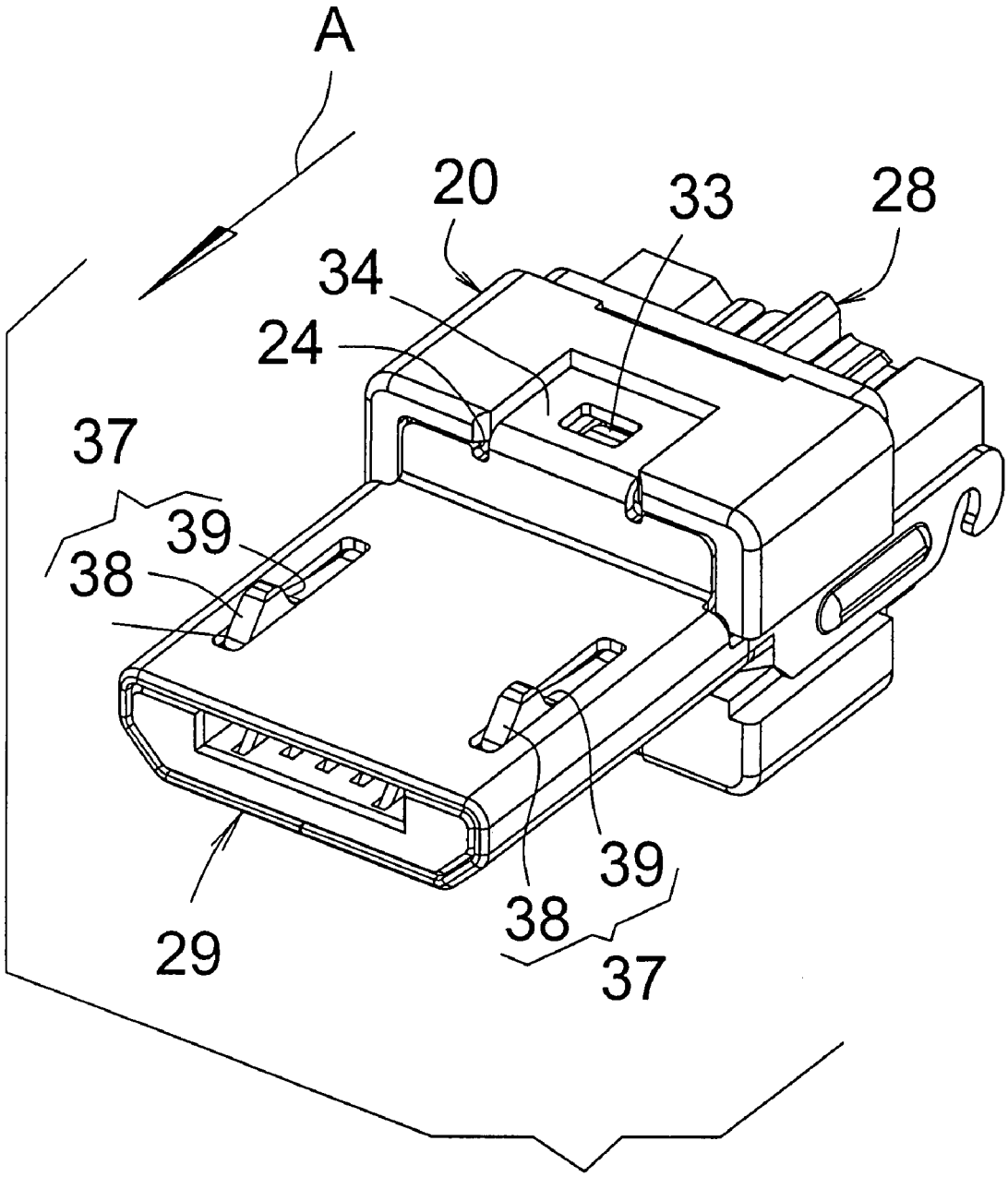
FIG. 7 is an assembled view of the entire electric connector of the present invention.
Figure 8:
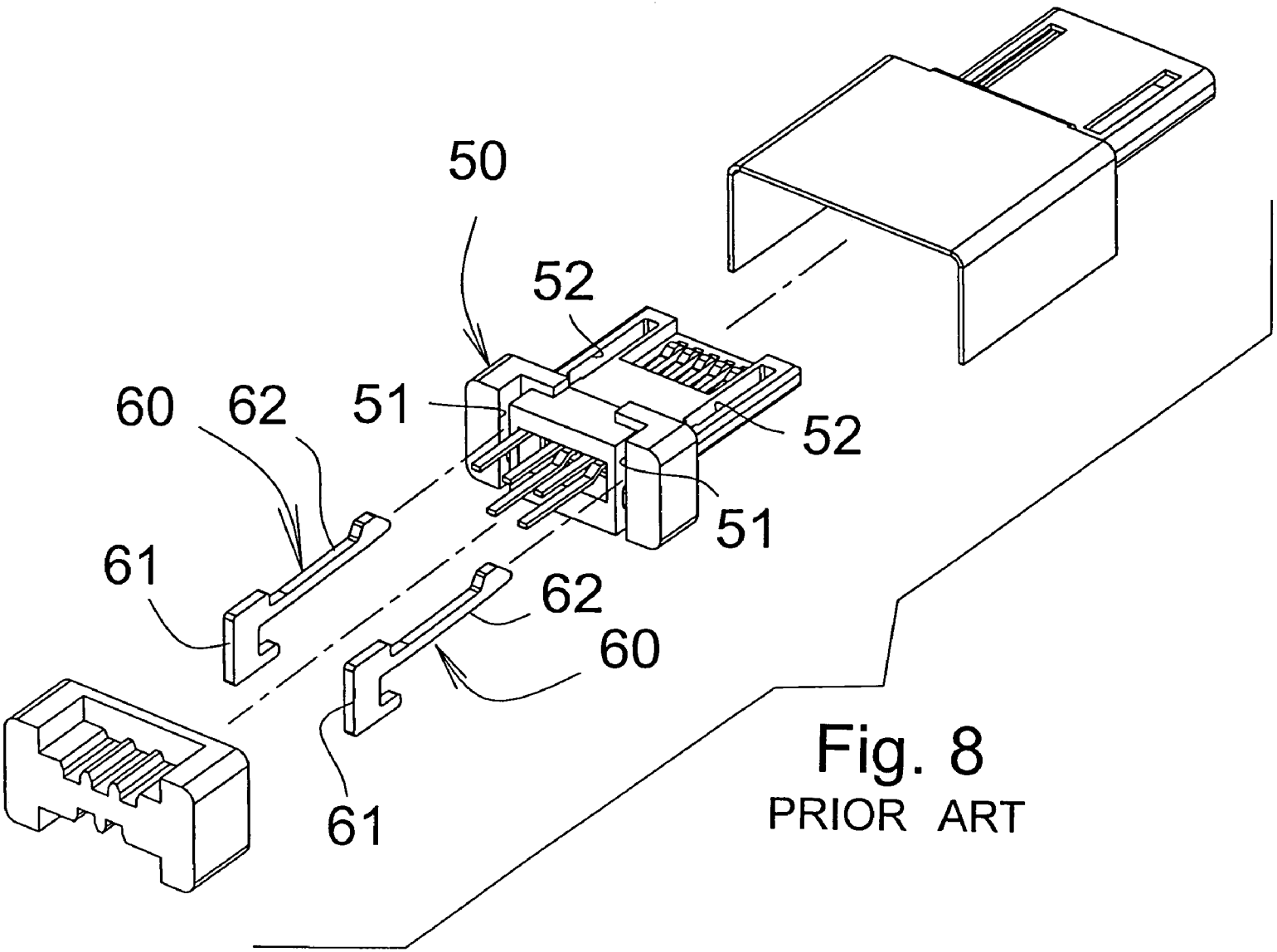
Fig. 8 PRIOR ART
FIG. 8 is a perspective exploded view of a conventional electric connector.

Referring to FIGS. 1, 2, 5 and 6, multiple contact terminals 21 are inlaid in the insulating main body 20. The insulating main body 20 is formed with an insertion slot 22 composed of a U-shaped insertion passage 23, a first locating channel 24, a second locating channel 25 (as shown in FIG. 6) and a locating pit 26. The U-shaped insertion passage 23 extends in a direction A in which the contact terminals 21 are inserted into the insulating main body 20. The first locating channel 24 extends from a middle section of the U-shaped insertion passage 23 in the direction A in which the contact terminals 21 are inserted into the insulating main body 20. The locating pit 26 is formed under the first locating channel 24 to communicate therewith. The second locating channel 25 (as shown in FIG. 6) extends from two ends of the U-shaped insertion passage 23 in the direction A in which the contact terminals 21 are inserted into the insulating main body 20.

Referring to FIGS. 1, 2, 5 and 6, the latch member 30 includes an insertion section 31 and two latch arms 36. The insertion section 31 is inserted in the insertion slot 22 of the insulating main body 20. The insertion section 31 has a U-shaped insertion section 32 inlaid in the U-shaped insertion passage 23 of the insertion slot 22 of the insulating main body 20. The insertion section 31 further has a first locating section 34 extending from the U-shaped insertion section 32 in the direction A in which the contact terminals 21 are inserted into the insulating main body 20. The first locating section 34 is inserted in the first locating channel 24 of the insertion slot 22 of the insulating main body 20. The first locating section 34 has a latch section 33 extending in a direction reverse to the direction A in which the contact terminals 21 are inserted into the insulating main body 20. The latch section 33 is fixedly latched in the locating pit 26 under the first locating channel 24 so as to fix the latch member 30 in the insertion slot 22 of the insulating main body 20. By means of such structure, even after many times of insertion/extraction between the electric connectors, the latch member 30 will not loosen or detach. The latch section 33 can be pressed into the locating pit 26 by means of a tool after assembled. Alternatively, the latch section 33 can be previously bent and then resiliently pressed into and latched in the locating pit 26.

The second locating section 35 extends from two ends of the U-shaped insertion section 32 in the direction A in which the contact terminals 21 are inserted into the insulating main body 20. The second locating section 35 is inserted in the second locating channel 25 of the insertion slot 22 of the insulating main body 20 (as shown in FIG. 6) so as to firmly fix the latch member 30 in the insulating main body 20. Two latch arms 36 respectively extend from two ends of the U-shaped insertion section 32 in the direction A in which the contact terminals 21 are inserted into the insulating main body 20. The latch arms 36 respectively resiliently extend into the U-shaped insertion passage 23 of the insulating main body 20. Each latch arm 36 has a latch hook 37 at the free end. The latch hook 37 is exposed to outer side of the insulating main body 20 for resiliently engaging with another electric connector.

Referring to FIGS. 1, 2, 5 and 6, each latch hook 37 has a guide slope 38 formed on the rearmost free end of the latch arm 36 for the latch hook 37 to easily slip into another electric connector. The latch hook 37 further has a latch slope 39 opposite to the guide slope 38 for latching with another electric connector and guiding the other electric connector to slip away from the present electric connector.

Figure 1:
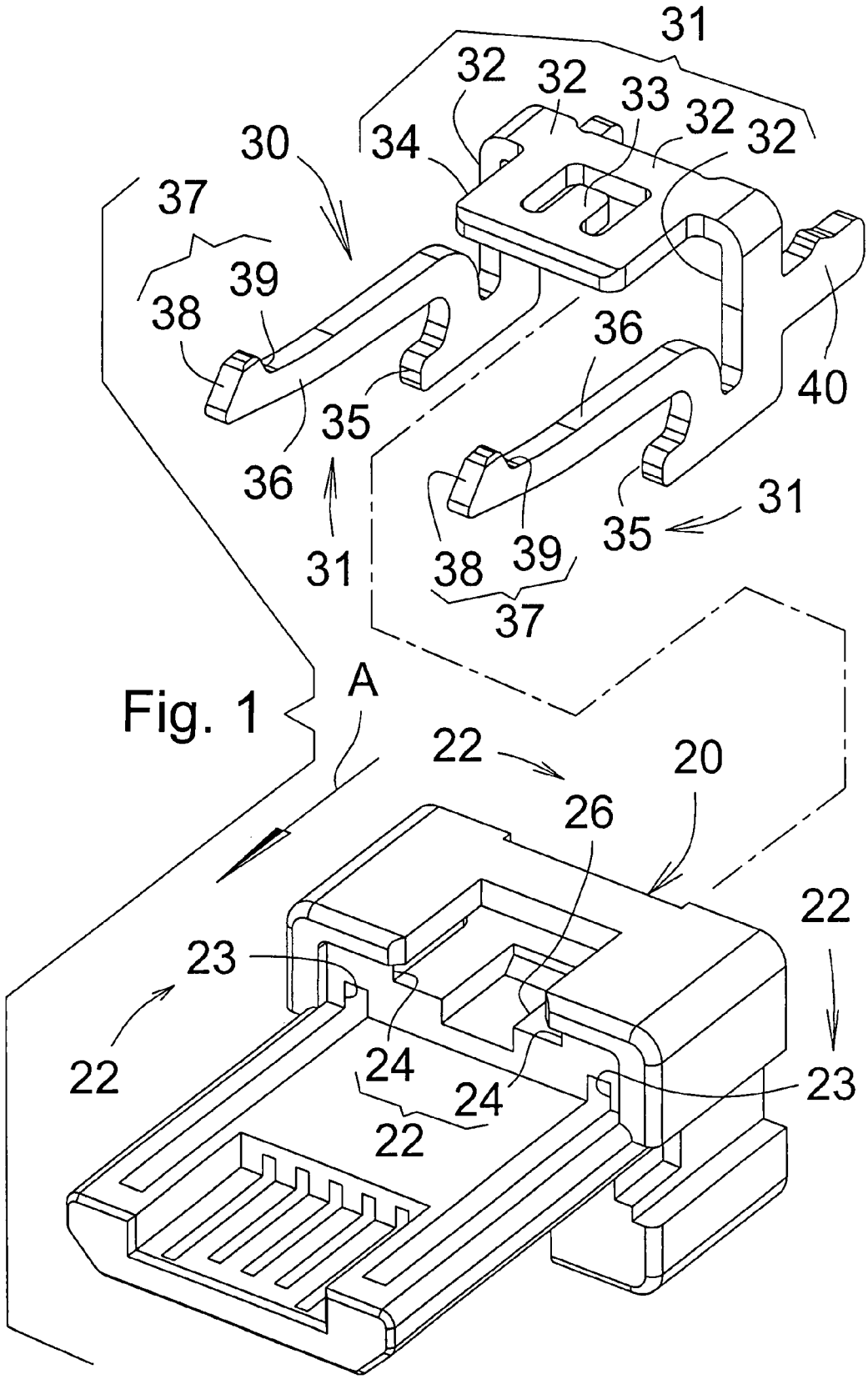
FIG. 1 is a perspective exploded view of the insulating main body and the latch member of the present invention, seen from front end.
Figure 2:
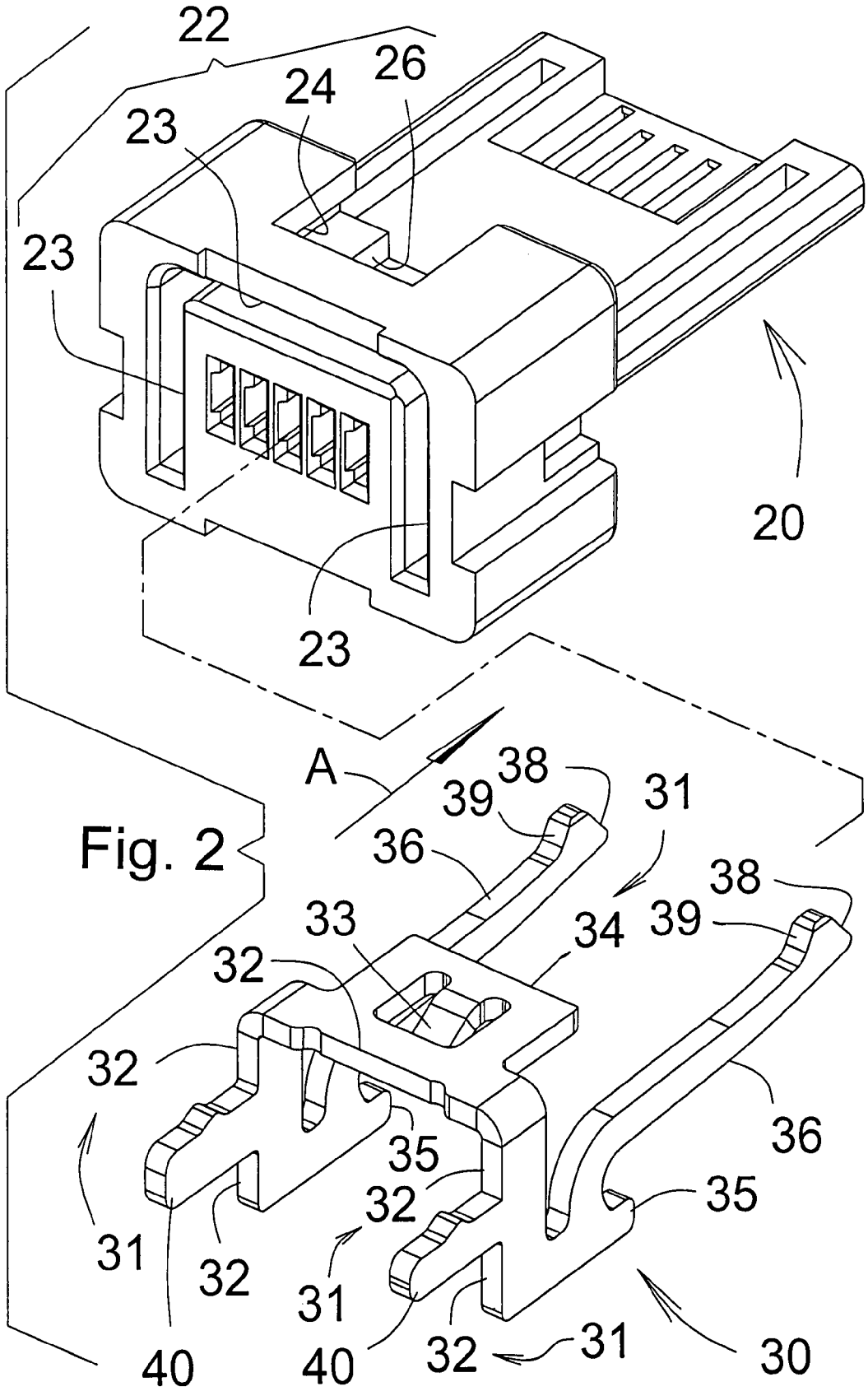
FIG. 2 is a perspective exploded view of the insulating main body and the latch member of the present invention, seen from rear end.

Referring to FIGS. 1, 2 and 3, the latch member 30 has a third locating section 40 extending from two ends of the U-shaped insertion section 32 in a direction reverse to the direction A in which the contact terminals 21 are inserted into the insulating main body 20. The third locating section 40 is fixedly inserted into the sockets 41 of two sides of the rear cap 28 fitted on the rear end of the insulating main body

20. This not only more firmly fixes the latch member 30, but also more firmly fixes the rear cap 28 with the insulating main body 20.

Referring to FIGS. 1, 2 and 6, the latch member 30 is integrally made from a piece of metal material to have the insertion section 31 and the two latch arms 36.

When the present electric connector is inserted with another electric connector, the guide slopes 38 of the latch arms 36 can smoothly slide into the other electric connector. When the present electric connector is extracted from another electric connector, the latch slopes 39 of the latch arms 36 can smoothly slip out of the other electric connector.

According to the above arrangement, the present invention has the following advantages:

1. The latch member 30 is fixed in the insertion slot 22 of the insulating main body 20. The insertion section 31 of the latch member 30 contacts the corresponding locating face of the insertion slot 22 by large area. Therefore, when the latch member 30 is under an external force, the large area of the latch member 30 bears the external force. Therefore, the force applied to unit area of the insulating main body 20 by the insertion section 31 is minified. Accordingly, the problem of deformation of the insulating main body 20 can be obviated. As a result, the latch member 30 will not loosen or detach from the insulating main body 20. Therefore, the present electric connector can be more firmly and reliably connected with another electric connector.
2. After assembled, the latch section 33 of the latch member 30 can be pressed into and fixedly latched in the locating pit 26 under the first locating channel 24 by means of a tool. Alternatively, the latch section 33 can be previously bent and then resiliently pressed into and latched in the locating pit 26. The locating pit 26 forms a reliable stopper structure for stopping the cooperative latch section 33 and thus preventing the latch member 30 from being retreated by external force.
3. The latch member 30 is integrally formed so that the latch member 30 can be assembled with the insulating main body 20 by one step, not twice. This promotes the assembling efficiency.

The above embodiments are only used to illustrate the present invention, not intended to limit the scope thereof. Many modifications of the above embodiments can be made without departing from the spirit of the present invention.

What is claimed is:

1. A micro-serial port electric connector comprising:

an insulating main body in which multiple contact terminals are inlaid, the insulating main body being formed with an insertion slot composed of:

a U-shaped insertion passage extending in a direction in which the contact terminals are inserted into the insulating main body;

a first locating channel extending from a middle section of the U-shaped insertion passage in the direction in which the contact terminals are inserted into the insulating main body;

a locating pit formed under the first locating channel to communicate therewith; and a second locating channel extending from two ends of the U-shaped insertion passage in the direction in which the contact terminals are inserted into the insulating main body; and a latch member having an insertion section inserted in the insertion slot of the insulating main body, the insertion section including:

a U-shaped insertion section inlaid in the U-shaped insertion passage of the insertion slot of the insulating main body;

a first locating section extending from the U-shaped insertion section in the direction in which the contact terminals are inserted into the insulating main body, the first locating section being inserted in the first locating channel of the insertion slot of the insulating main body, the first locating section having a latch section extending in a direction reverse to the direction in which the contact terminals are inserted into the insulating main body, the latch section being fixedly latched in the locating pit under the first locating channel so as to fix the latch member in the insertion slot of the insulating main body; and a second locating section extending from two ends of the U-shaped insertion section in the direction in which the contact terminals are inserted into the insulating main body, the second locating section being inserted in the second locating channel of the insertion slot of the insulating main body, the latch member further having two latch arms respectively extending from two ends of the U-shaped insertion section in the direction in which the contact terminals are inserted into the insulating main body, the latch arms respectively resiliently extending into the U-shaped insertion passage of the insulating main body, each latch arm having a latch hook at the free end, the latch hooks being exposed to outer side of the insulating main body for resiliently engaging with another electric connector, each latch hook having a guide slope formed on a rearmost free end of the latch arm for the latch hook to easily slip into another electric connector, the latch hook further having a latch slope opposite to the guide slope for latching with another electric connector and guiding the other electric connector to slip away from the electric connector.

2. The micro-serial port electric connector as claimed in claim 1, wherein the latch member is integrally made from a piece of metal material to have the insertion section and the two latch arms.

3. A micro-serial port electric connector comprising:

an insulating main body in which multiple contact terminals are inlaid, the insulating main body being formed with an insertion slot having a U-shaped insertion passage; and a latch member having an insertion section inserted in the insertion slot of the insulating main body, the insertion section including:

a U-shaped insertion section inlaid in the U-shaped insertion passage of the insertion slot of the insulating main body; and two latch arms respectively extending from two ends of the U-shaped insertion section in the direction in which the contact terminals are inserted into the insulating main body, the latch arms respectively resiliently extending into the U-shaped insertion passage of the insulating main body, each latch arm having a latch hook at the free end, the latch hooks being exposed to outer side of the insulating main body for resiliently engaging with another electric connector, each latch hook having a guide slope formed on a rearmost free end of the latch arm for the latch hook to easily slip into another electric connector, the latch hook further having a latch slope opposite to the guide slope for latching with another electric connector and guiding the other electric connector to slip away from the electric connector.

4. A micro-serial port electric connector comprising:

an insulating main body in which multiple contact terminals are inlaid, the insulating main body being formed with an insertion slot having a U-shaped insertion passage; and a latch member having an insertion section inserted in the insertion slot of the insulating main body, the insertion section including:

a U-shaped insertion section inlaid in the U-shaped insertion passage of the insertion slot of the insulating main body; and two latch arms respectively extending from two ends of the U-shaped insertion section in the direction in which the contact terminals are inserted into the insulating main body, the latch arms respectively resiliently extending into the U-shaped insertion passage of the insulating main body, each latch arm having a latch hook at the free end, the latch hooks being exposed to outer side of the insulating main body for resiliently engaging with another electric connector, the latch member being integrally made from a piece of metal material to have the insertion section and the two latch arms.

5. The micro-serial port electric connector as claimed in claim 4, wherein the insulating main body further has a first locating channel extending from a middle section of the U-shaped insertion passage in the direction in which the contact terminals are inserted into the insulating main body.

6. The micro-serial port electric connector as claimed in claim 4, wherein the latch member further has a first locating section extending from the U-shaped insertion section in the direction in which the contact terminals are inserted into the insulating main body, the first locating section being inserted in the first locating channel of the insertion slot of the insulating main body, the first locating section having a latch section extending in a direction reverse to the direction in which the contact terminals are inserted into the insulating main body, whereby the entire latch member can be fixedly latched in the insulating main body.

7. The micro-serial port electric connector as claimed in claim 4, wherein the insulating main body further has a locating pit formed under the first locating channel to communicate therewith, the first locating section having a latch section fixedly latched in the locating pit under the first locating channel so as to fix the latch member in the insertion slot of the insulating main body.

8. The micro-serial port electric connector as claimed in claim 4, wherein the insulating main body further ahs a second locating channel extending from two ends of the U-shaped insertion passage in the direction in which the contact terminals are inserted into the insulating main body, the latch member further having a second locating section extending from two ends of the U-shaped insertion section in the direction in which the contact terminals are inserted into the insulating main body, the second locating section being inserted in the second locating channel of the insertion slot of the insulating main body.

* * * * *